US007027011B2

(12) United States Patent
Makino

(10) Patent No.: US 7,027,011 B2
(45) Date of Patent: Apr. 11, 2006

(54) METHOD OF DRIVING PLASMA DISPLAY PANEL

(75) Inventor: Mitsuyoshi Makino, Tokyo (JP)

(73) Assignee: Pioneer Corporation, Tokyo (JP)

( * ) Notice: Subject to any disclaimer, the term of this patent is extended or adjusted under 35 U.S.C. 154(b) by 417 days.

(21) Appl. No.: 10/392,944

(22) Filed: Mar. 21, 2003

(65) Prior Publication Data

US 2003/0184502 A1 Oct. 2, 2003

(30) Foreign Application Priority Data

Mar. 29, 2002 (JP) ..... 2002-097945

(51) Int. Cl.
*G09G 3/28* (2006.01)

(52) U.S. Cl. ..... 345/60; 345/66; 345/68

(58) Field of Classification Search ..... 345/60, 345/61, 62, 63, 66, 67, 68
See application file for complete search history.

(56) References Cited

U.S. PATENT DOCUMENTS 6,127,992 A * 10/2000 Sano ..... 345/60
6,362,799 B1 * 3/2002 Ueoka et al. ..... 345/60
6,803,722 B1 * 10/2004 Nakamura et al. ..... 313/582

FOREIGN PATENT DOCUMENTS

| | | |
|---|---|---|
| JP | 2001-184023 A | 7/2001 |
| JP | 2001-210238 A | 8/2001 |
| JP | 2001-242824 A | 9/2001 |
| JP | 2002-14652 A | 1/2002 |

* cited by examiner

*Primary Examiner*—Dennis-Doon Chow
(74) *Attorney, Agent, or Firm*—Sughrue Mion, PLLC

(57) ABSTRACT

A method of driving a plasma display panel including a plurality of scanning electrodes covered with a dielectric layer, and a plurality of sustaining electrodes covered with a dielectric layer, including the steps of (a) applying scanning pulses in time-division to the scanning electrodes in an addressing period in which a cell or cells emitting light is(are) selected, and applying sustaining pulses to the sustaining electrodes in a sustaining period for generating preliminary discharge and preliminary erasing discharge before the cell or cells emitting light is(are) selected, and (b) applying a serrate pulse to the scanning or sustaining electrodes when the preliminary erasing discharge is generated, the serrate pulse having an inclination smaller than 10 V/μs, wherein a period of time until the generation of the preliminary erasing discharge from the termination of the preliminary discharge is set shorter than 3T where T indicates a decay time constant of priming particles.

19 Claims, 10 Drawing Sheets

DISCHARGE GAS : Ne(96%)-Xe(4%) 400torr

CELL SIZE : 0.27mm×0.81mm

DISCHARGE GAS : Ne(96%)-Xe(4%) 400torr

CELL SIZE : 0.27mm×0.81mm

METHOD OF DRIVING PLASMA DISPLAY PANEL

BACKGROUND OF THE INVENTION

1. Field of the Invention

The invention relates to a method of driving a plasma display panel (PDP) which is one of flat display panels which can be readily formed in a larger size, and more particularly to such a method which makes it possible, after priming discharge or preliminary discharge has been generated in all of cells, but prior to addressing action carried out for determining a cell or cells which emit(s) light, to generate priming erasing discharge for controlling wall charges generated by the preliminary discharge.

2. Description of the Related Art

A plasma display panel is presently used in various fields such as a personal computer, a display of a work-station, or a television set hung over a wall. A plasma display panel can be structurally grouped into a direct current (DC) type panel in which electrodes are exposed to discharge gas, and an alternate current (AC) type panel in which electrodes are covered with a dielectric film, and hence, are not exposed to discharge gas. An alternate current (AC) type panel is grouped further into a memory operation type panel which makes use of a memory function caused by a charge-accumulation function of the dielectric film, and a refresh operation type panel which does not make use of the memory function.

FIG. 1 is a cross-sectional view of a conventional AC type plasma display panel.

The illustrated plasma display panel includes a front substrate 1 and a rear substrate 2 both of which are composed of glass.

On the front substrate 1 are formed a plurality of scanning electrodes 3 and a plurality of sustaining electrodes 4 all extending in a direction perpendicular to a plane of FIG. 1. Each of the scanning electrodes 3 is equally spaced away from each of the sustaining electrodes 4. A dielectric layer 5*a* is formed on the front substrate 1 such that the dielectric layer 5*a* entirely covers the scanning and sustaining electrodes 3 and 4 therewith. A protection layer 6 is formed entirely over the dielectric layer 5*a*. The protection layer 6 is composed of magnesium oxide (MgO), and protects the dielectric layer 5*a* from discharge generated in a discharge space 9 defined between the front and rear substrates 1 and 2.

On the rear substrate 2 is formed a plurality of data electrodes extending in a direction perpendicular to a direction in which the scanning and sustaining electrodes 3 and 4 extend. The data electrodes 8 are covered with a dielectric layer 5*b*. Phosphor 7 is coated over the dielectric layer 5*b* for converting ultra-violet light generated by discharge, into visible light. A color plasma display panel is fabricated, if red, green and blue phosphors are coated in every three cells.

Between the dielectric layers 5*a* and 5*b* is formed a partition wall 10 for defining discharge spaces 9 and partitioning cells. A discharge gas composed of He, Ne and Xe is introduced into each of the discharge spaces 9.

FIG. 2 is a plan view of the scanning, sustaining and data electrodes 3, 4 and 8 of the plasma display panel illustrated in FIG. 1.

As illustrated in FIG. 2, first to m-th scanning electrodes Si (i=1, 2, - - - , m) are formed to extend in a column direction, and first to n-th data electrodes Dj (j=1, 2, - - - , n) are formed to extend in a row direction. A cell is formed at each of intersections of the scanning and data electrodes.

First to m-th sustaining electrodes are formed to extend in a column direction in parallel with the scanning electrodes Si. Each of the first to m-th scanning electrodes Si and each of the sustaining electrodes Ci make a pair.

FIG. 3 is a timing chart showing waveforms of driving voltages to be applied to the scanning, sustaining and data electrodes 3, 4 and 8. Hereinbelow is explained a method of driving the AC type plasma display panel, with reference to FIG. 3.

First, a first preliminary discharge pulse 11*a* having a sign which is negative with respect to a base voltage of a sustaining electrode is applied to the sustaining electrodes 4, and a second preliminary discharge pulse 11*b* having a sign which is positive with respect to a base voltage of a sustaining voltage is applied to the scanning electrodes 3. As a result, a voltage difference exceeding a threshold voltage at which discharge starts is applied across the scanning electrodes 3 and the sustaining electrodes 4, and thus, discharge is compulsorily generated in all cells.

The first preliminary discharge pulse 11*a* is rectangular in shape. Hence, a voltage drastically varies at leading and trailing edges of the first preliminary discharge pulse 11*a*. The second preliminary discharge pulse 11*b* is serrate in shape, and hence, a voltage gently varies at a leading edge of the second preliminary discharge pulse 11*b*. An inclination of the leading edge of the second preliminary discharge pulse 11*b* is set smaller than about 10 V/μs.

Then, a preliminary erasing discharge pulse 12 having a sign which is negative with respect to a base voltage of a scanning electrode is applied to the scanning electrodes 3 for generating discharge in all cells to thereby put wall charges into an initial state for generating writing discharge afterwards.

The preliminary erasing discharge pulse 12 is serrate in shape, and hence, a voltage gently varies at a leading edge of the preliminary erasing discharge pulse 12. An inclination of the leading edge of the preliminary erasing discharge pulse 12 is set smaller than about 10 V/μs.

Discharge generated by the first and second preliminary discharge pulses 11*a* and 11*b* is called preliminary discharge, and discharge generated by the preliminary erasing discharge pulse 12 is called preliminary erasing discharge. Subsequent writing discharge is stably generated by virtue of the preliminary discharge and preliminary erasing discharge.

After the preliminary discharge and preliminary erasing discharge have been generated, a scanning pulse 13 is applied to each of the scanning electrodes S1 to Sm at different timings from one another. The scanning pulse 13 has a sign which is negative with respect to a base voltage of a scanning electrode.

In synchronization with the scanning pulse 13, a data pulse 14 is applied to the data electrodes D1 to Dn in accordance with image data. The data pulse 14 has a sign which is positive with respect to a base voltage of a data electrode. An oblique line in each of the data pulses 14 indicates whether presence or absence of the data pulse 14 is determined in accordance with presence or absence of image data for a cell.

In a cell in which the data pulse 14 is applied to the data electrode 8 while the scanning pulse 13 is being applied to the scanning electrode 3, discharge is generated in the discharge space 9 defined between the scanning electrode 3 and the data electrode 8. In contrast, if the data pulse 14 is not applied to the data electrode 8 while the scanning pulse 13 is being applied to the scanning electrode 3, discharge is not generated in the discharge space 9. Image data is written into a cell in accordance with presence or absence of the discharge, the discharge is called a writing discharge.

In the above-mentioned writing discharge, the discharge generated between the scanning electrode 3 and the data electrode 8 triggers discharge between the scanning electrode 3 and the sustaining electrode 4. In order to cause the discharge between the scanning electrode 3 and the sustaining electrode 4 to be stably generated, a voltage difference between the scanning electrode 3 and the sustaining electrode 4 in the writing discharge may be increased by applying a bias voltage or scanning sub-pulse 17 to the sustaining electrodes 4. The scanning sub-pulse 17 has a sign which is positive with respect to a base voltage of a sustaining electrode. In order to shorten an amplitude of the scanning pulse 13, a bias voltage or scanning base pulse 18 may be applied to the scanning electrodes 3. The scanning base pulse 18 has a sign which is negative with respect to a base voltage of a scanning electrode.

In a cell in which the writing discharge has been generated, positive charges called "wall charges" are accumulated on the dielectric layer 5*a* above the scanning electrodes 3. In contrast, negative wall charges are accumulated on the dielectric layer 5*b* above the data electrodes 8. Thereafter, a positive voltage caused by the positive wall charges accumulated on the dielectric layer 5*a* above the scanning electrodes 3, and a first sustaining pulse 15*a* having a negative sign and applied to the sustaining electrodes 4 overlap each other with the result that first discharge is generated.

If discharge is generated also between the scanning electrode 3 and the sustaining electrode 4 during the wiring discharge, negative wall charges are accumulated on the dielectric layer 5*a* above the sustaining electrodes 4 by the writing discharge. As a result, a positive voltage caused by the positive wall charges accumulated on the dielectric layer 5*a* above the scanning electrodes 3 and a negative voltage caused by the negative wall charges caused by the dielectric layer 5*a* above the sustaining electrodes 4 are added to the first sustaining pulse 15*a*, resulting in that first discharge is generated.

After the first discharge has been generated, positive wall charges are accumulated on the dielectric layer 5*a* above the sustaining electrodes 4, and negative wall charges are accumulated on the dielectric layer 5*a* above the scanning electrodes 3. A second sustaining pulse 15*b* to be applied to the scanning electrodes 3 is added to a voltage difference between the above-mentioned positive and negative wall charges, resulting in that second discharge is generated.

In the same way as mentioned above, a voltage difference caused by positive and negative wall charges accumulated by n-th discharge is added to a (n+1)-th sustaining pulse 15*b*, resulting in that discharge is kept generated. Hence, discharge caused by the above-mentioned action is called sustaining discharge. A luminance is dependent on the number of sustaining discharges.

If the sustaining pulses 15*a* and 15*b* are designed to have a voltage at which discharge is not generated merely by applying the sustaining pulses 15*a* and 15*b* to the sustaining and scanning electrodes 4 and 3, first sustaining discharge is not generated even if the first sustaining pulse 15*a* is applied to the sustaining electrodes 4 in a cell in which the writing discharge has not been generated, because a voltage caused by wall charges is not generated before applying the first sustaining pulse 15*a* to the sustaining electrodes 4. Accordingly, subsequent sustaining discharges are not generated.

After the sustaining pulses 15*a* and 15*b* have been applied to the sustaining electrodes 4 and the scanning electrodes 3, respectively, a sustaining erasing pulse 16 having a sign which is negative with respect to a base voltage of a scanning electrode is applied to all of the scanning electrodes 3 to thereby generate discharge in a cell in which the sustaining discharge has been kept generated. As a result, a wall charge profile is initialized. The sustaining erasing pulse 16 is a serrate pulse having a leading edge varying smaller than about 10 V/μs. Discharge caused by the sustaining erasing pulse 16 is called sustaining discharge erasion.

With reference to FIG. 3, a period in which the preliminary discharge pulses 11*a* and 11*b* and the preliminary erasing discharge pulse 12 are applied to the sustaining electrodes 4 and the scanning electrodes 3 is called a preliminary discharge period, a period in which the scanning pulse 13, the data pulse 14, the scanning sub-pulse 17 (if necessary), and the scanning base pulse 18 (if necessary) are applied to the electrodes is called a scanning or addressing period, a period in which the sustaining pulses 15*a* and 15*b* are applied to the sustaining and scanning electrodes 4 and 3 is called a sustaining period, and a period in which the sustaining erasing pulse 16 is applied to the scanning electrodes 3 is called a sustaining erasing period. A combination of a preliminary discharge period, a scanning period, a sustaining period and a sustaining erasing period makes a sub-field.

A method of displaying images at a certain gray scale in a conventional plasma display panel is explained hereinbelow with reference to FIG. 4.

A field defined as a period in which one picture is to be displayed is divided into a plurality of sub-fields. For instance, a field is 1/60 seconds, and is divided into four sub-fields. Each of the sub-fields has such a structure as illustrated in FIG. 4, and is controlled to be turned on or off independently of other sub-fields. The sub-fields have sustaining periods different from one another. In other words, the sustaining pulses 15*a* and 15*b* are applied to the sustaining and scanning electrodes 4 and 3 in each of the sub-fields in the different numbers from one another, and hence, the sub-fields provide different luminances from one another.

When a field is divided into four sub-fields as illustrated in FIG. 4, it is assumed that a ratio in luminance obtained when light is emitted solely in each of the sub-fields is set 1:2:4:8, for instance. Thus, it would be possible to display images at sixteen (16) luminance ratios from zero (0) to fifteen (15) in accordance with a combination of four sub-fields in each of which light is emitted or not. Herein, if no light is emitted in all of the sub-fields, a luminance ratio would be zero, and if light is emitted in all of the sub-fields, a luminance ratio would be fifteen.

If a field is divided into N sub-fields, and a luminance ratio in the N sub-fields is set at 1 ($=2^0$): 2 ($=2^1$): - - - : $2^{(N-2)}$: $2^{(N-1)}$, it would be possible to display images at $2^N$ gray scales.

However, the above-mentioned conventional method of driving a plasma display panel is accompanied with a problem that excessively intensive discharge might be generated, when the preliminary erasing discharge pulse 12 having a leading edge varying at a rate smaller than 10 V/μs is applied to the scanning electrodes 3, resulting in that sustaining discharge is generated regardless of whether the writing discharge has been generated, in a cell in which excessively intensive preliminary erasing discharge has been generated.

Japanese Patent Application Publication No. 2001-184023 has suggested a display unit including a plurality of first electrodes arranged in a first direction, a plurality of second electrodes arranged in a second direction perpendicular to the first direction, a plurality of third electrodes each of which makes a pair with each of the first electrodes, and a controller which adjusts a wall voltage difference between the first and third electrodes, and further adjusts a wall voltage difference between the first and second electrodes independently of the adjustment of the wall voltage difference between the first and third electrodes, before addressing discharge is generated between the first and second electrodes.

Japanese Patent Application Publication No. 2001-210238 has suggested an AC type plasma display panel including a first substrate, and a second substrate facing the first substrate with discharge space being sandwiched therebetween. On the first substrate are formed a first electrode, a second electrode extending in parallel with the first electrode, and a dielectric layer covering the first and second electrode therewith. On the second substrate is formed a third electrode extending in a direction perpendicular to a direction in which the first electrode extends. A distance between the first and second electrodes is set greater than a height of the discharge space.

Japanese Patent Application Publication No. 2001-242824 has suggested a method of driving a plasma display panel including a discharge cell which includes a first electrode and a second electrode and which can control whether discharge is generated in accordance with a voltage difference between the first and second electrodes, the method including the step of applying a pulse successively varying from a first voltage to a second voltage, to the first electrode. The step further includes the first step of forming a first region of the pulse in accordance with a first pulse-generation process, and the second step of forming a second region of the pulse in accordance with a second pulse-generation process.

Japanese Patent Application Publication No. 2002-14652 has suggested a method of driving a plasma display panel, in which images are displayed at a certain gray scale by means of a pulse having a increased-width portion, in a certain sub-field.

SUMMARY OF THE INVENTION

In view of the above-mentioned problem in the conventional method of driving a plasma display panel, it is an object of the present invention to provide a method of driving a plasma display panel which method is capable of preventing such erroneous discharge as mentioned above, and displaying images at high quality.

In one aspect of the present invention, there is provided a method of driving a plasma display panel including a plurality of scanning electrodes covered with a dielectric layer, and a plurality of sustaining electrodes covered with a dielectric layer, including the steps of (a) applying scanning pulses in time-division to the scanning electrodes in an addressing period in which a cell or cells emitting light is(are) selected, and applying sustaining pulses to the sustaining electrodes in a sustaining period for generating preliminary discharge and preliminary erasing discharge before the cell or cells emitting light is(are) selected, and (b) applying a serrate pulse to the scanning or sustaining electrodes when the preliminary erasing discharge is generated, the serrate pulse having an inclination smaller than 10 V/μs, wherein a period of time until the generation of the preliminary erasing discharge from the termination of the preliminary discharge is set shorter than 3T where T indicates a decay time constant of priming particles.

It is preferable that the priming particles are xenon (Xe) metastable level atoms, and the period of time is shorter than 58 microseconds.

There is further provided a method of driving a plasma display panel including a plurality of scanning electrodes covered with a dielectric layer, and a plurality of sustaining electrodes covered with a dielectric layer, including the steps of (a) applying scanning pulses in time-division to the scanning electrodes in an addressing period in which a cell or cells emitting light is(are) selected, and applying sustaining pulses to the sustaining electrodes in a sustaining period for generating preliminary discharge and preliminary erasing discharge before the cell or cells emitting light is(are) selected, and (b) applying a serrate pulse to the scanning or sustaining electrodes when the preliminary erasing discharge is generated, the serrate pulse having an inclination smaller than 10 V/μs, wherein in a period including a first period in which the serrate pulse is applied to one of the scanning and sustaining electrodes for generating the preliminary erasing discharge, a first pulse having a sign opposite to a sign of the serrate pulse with respect to a base voltage is applied to the other of the scanning and sustaining electrodes.

It is preferable that the serrate pulse is applied to the scanning electrodes and the first pulse is applied to the sustaining electrodes, and the first pulse has a voltage equal to a voltage of a pulse applied to the sustaining electrodes in the addressing period.

The method may further include the step of stopping applying a second voltage to the other of the scanning and sustaining electrodes for returning the other of the scanning and sustaining electrodes back to a base voltage, before the serrate pulse reaches a third voltage, wherein the second voltage is defined as a voltage having a sign opposite to a sign of the serrate pulse with respect to the base voltage to be applied to the other of the scanning and sustaining electrodes, the third voltage is defined as a voltage closer to the base voltage than a first voltage by a bias-voltage difference, the first voltage is defined as a voltage to which the serrate pulse finally reaches, and the bias-voltage difference is defined as a difference between the base voltage and the second voltage.

It is preferable that the first voltage is a ground (GND) voltage.

It is preferable that a first bias-voltage difference defined as a difference between a ground voltage and a first voltage is greater than a second bias-voltage difference between the base voltage and a second voltage, wherein the serrate pulse has a negative sign, the first voltage is defined as a voltage to which the serrate pulse finally reaches, and the second voltage is defined as a voltage which has a positive sign and is applied to the other of the scanning and sustaining electrodes.

It is preferable that a period of time until the generation of the preliminary erasing discharge from the termination of the preliminary discharge is set shorter than 3T where T indicates a decay time constant of priming particles.

It is preferable that a period of time until the generation of the preliminary erasing discharge from the termination of the preliminary discharge is set shorter than 58 microseconds.

It is preferable that a voltage to be applied to the scanning and sustaining electrodes is kept equal to a base voltage of the scanning and sustaining electrodes in a period between a period in which the preliminary discharge is generated and a period in which the next preliminary discharge is generated.

It is preferable that the base voltage is equal to a maximum or minimum of an amplitude of the sustaining pulse.

It is preferable that the maximum or minimum of an amplitude of the sustaining pulse is equal to a ground voltage.

There is still further provided a method of driving a plasma display panel including a plurality of scanning electrodes covered with a dielectric layer, and a plurality of sustaining electrodes covered with a dielectric layer, including the steps of (a) applying scanning pulses in time-division to the scanning electrodes in an addressing period in which a cell or cells emitting light is(are) selected, and applying sustaining pulses to the sustaining electrodes in a sustaining period for generating preliminary discharge and preliminary erasing discharge before the cell or cells emitting light is(are) selected, and (b) applying a serrate pulse to one of the scanning and sustaining electrodes when the preliminary erasing discharge is generated wherein the serrate pulse falls down to a first voltage from a base voltage at 100 V/μs or greater and falls down to a second voltage from the first voltage at 10 V/μs or smaller, or rises up to a first voltage from a base voltage at 100 V/μs or greater and rises up to a second voltage from the first voltage at 10 V/μs or smaller.

The advantages obtained by the aforementioned present invention will be described hereinbelow.

In accordance with the above-mentioned present invention, it is possible to prevent generation of intensive discharge in preliminary erasing discharge generated by using a serrate pulse having a leading edge gently varying. This ensures it possible to provide a plasma display panel in which erroneous discharge is not generated and which provides high quality in displaying images.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 1:
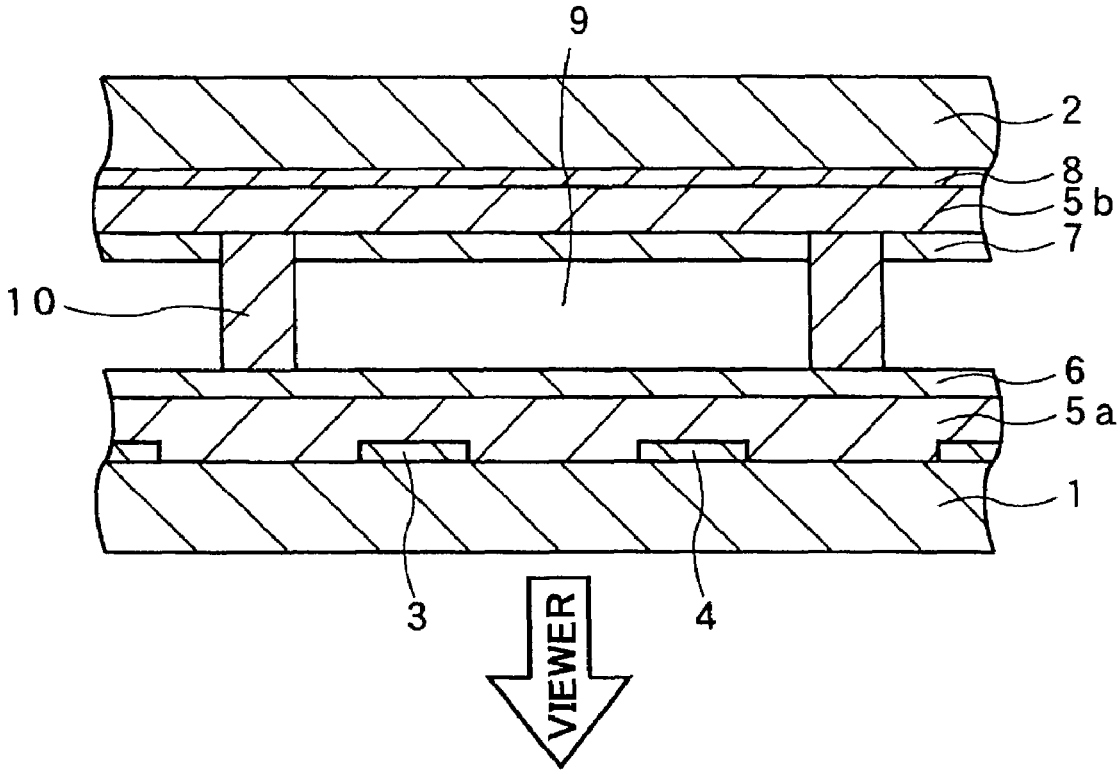
FIG.1 PRIOR ART
FIG. 1 is a cross-sectional view of a conventional AC type plasma display panel.
Figure 2:
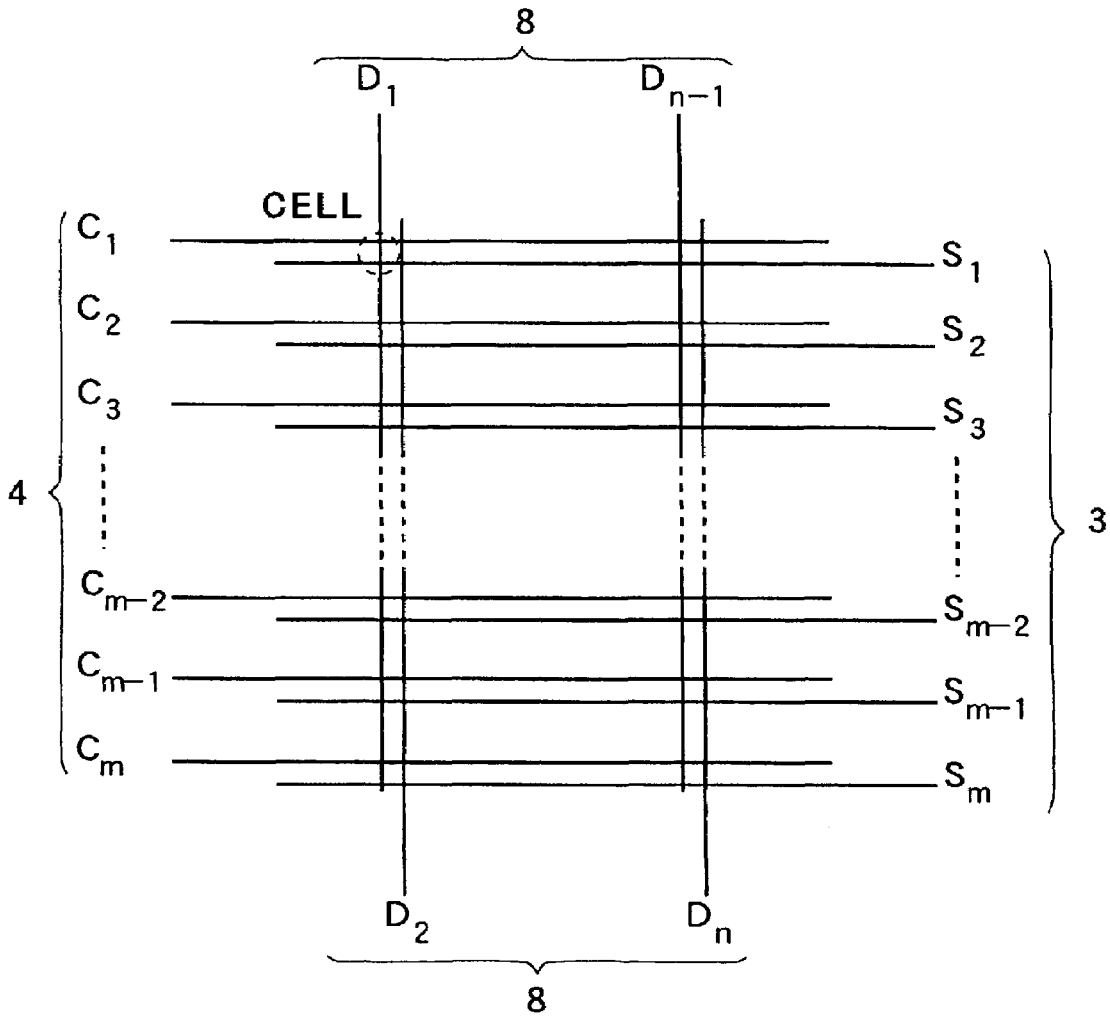
FIG.2 PRIOR ART
FIG. 2 is a plan view of scanning, sustaining and data electrodes of the plasma display panel illustrated in FIG. 1.
Figure 3:
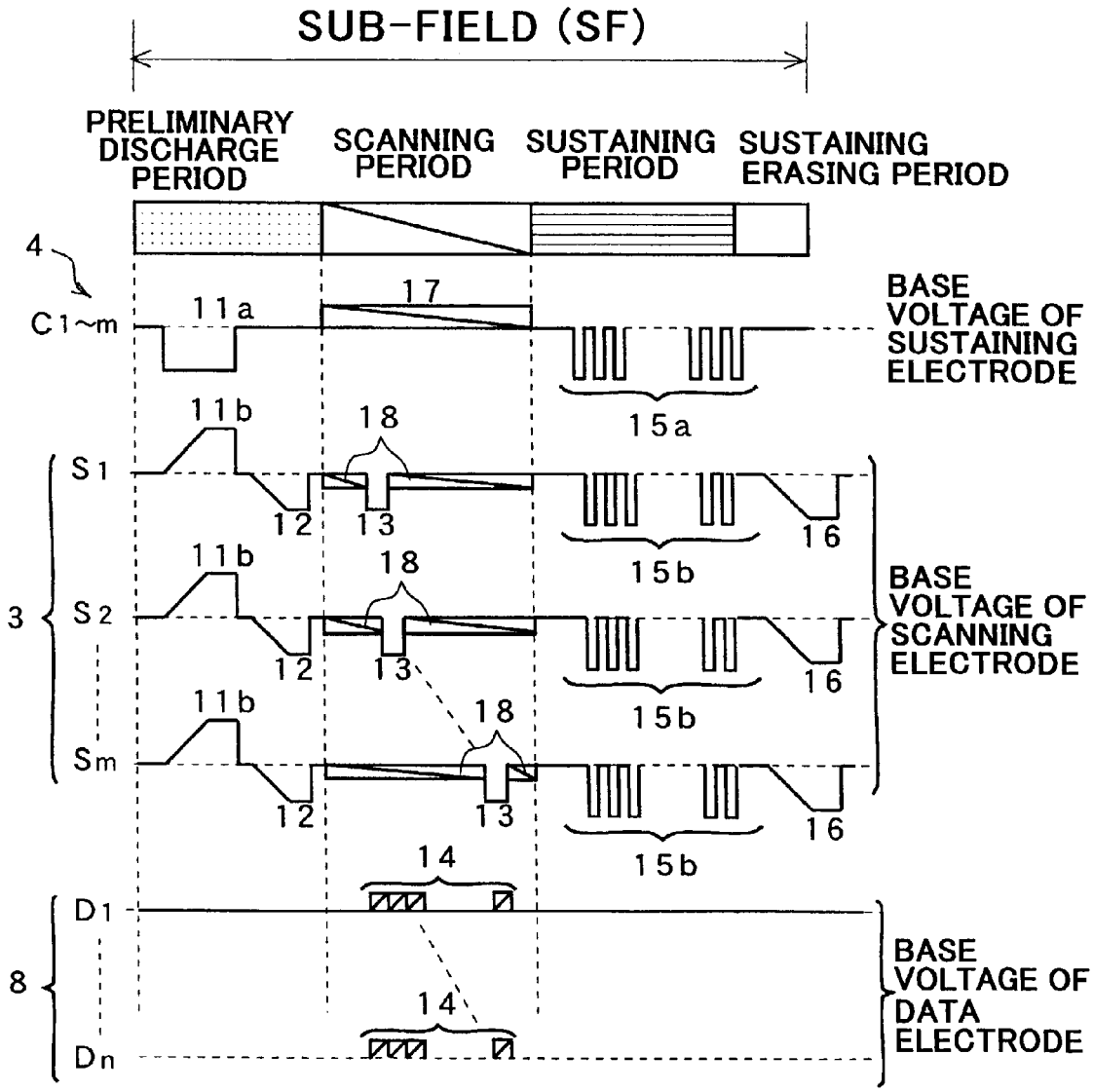
FIG.3 PRIOR ART
FIG. 3 is a timing chart showing waveforms of driving voltages to be applied to the scanning, sustaining and data electrodes in the plasma display panel illustrated in FIG. 1.
Figure 4:
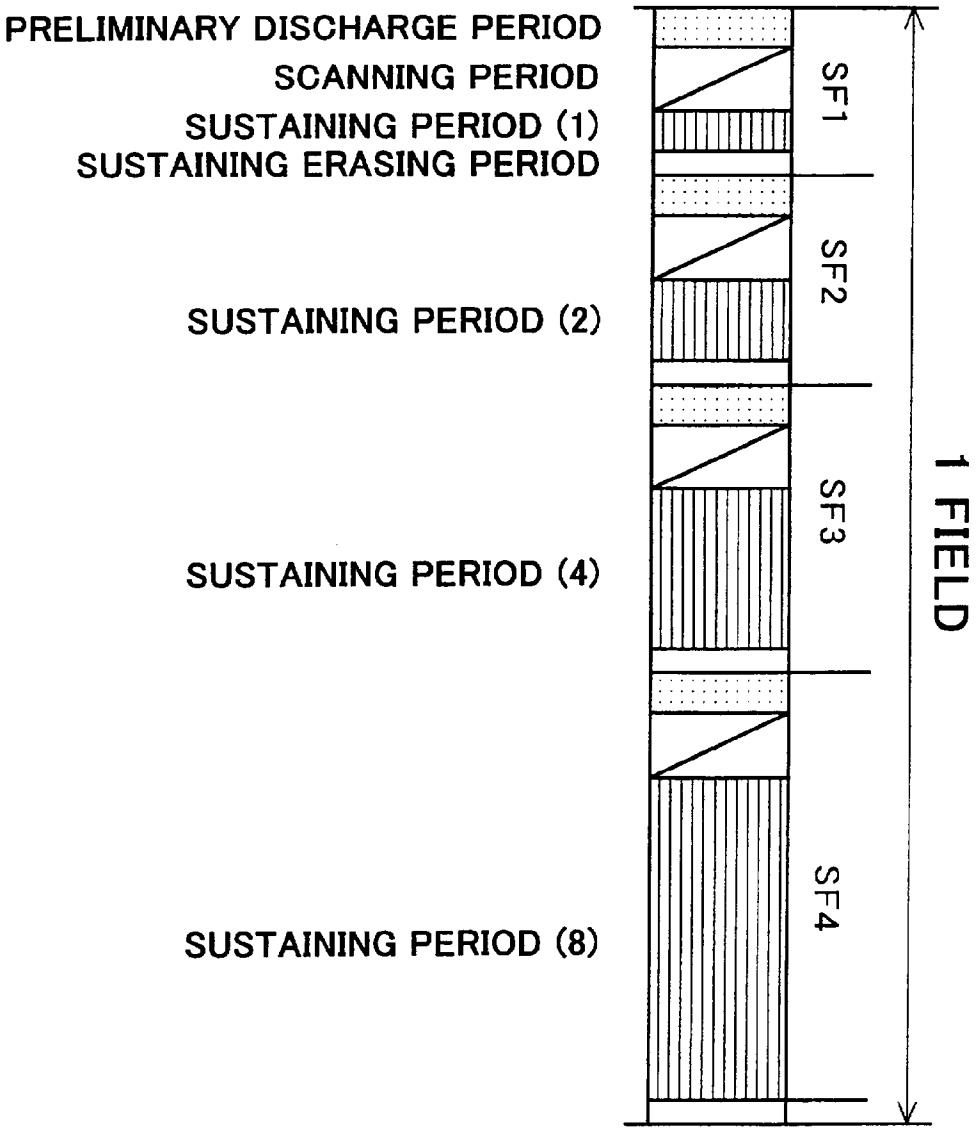
FIG.4 PRIOR ART
FIG. 4 is a timing chart showing four sub-fields divided from a field.
Figure 5A:
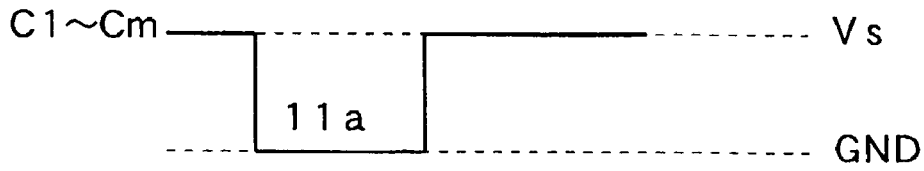
FIG. 5A illustrates a waveform of a pulse to be applied to a sustaining electrode in a preliminary discharge period in the first embodiment in accordance with the present invention.
Figure 5B:
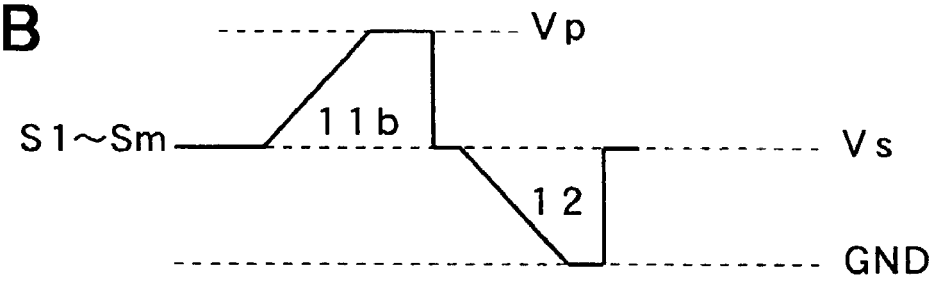
FIG. 5B illustrates a waveform of a pulse to be applied to a scanning electrode in a preliminary discharge period in the first embodiment in accordance with the present invention.
Figure 5C:
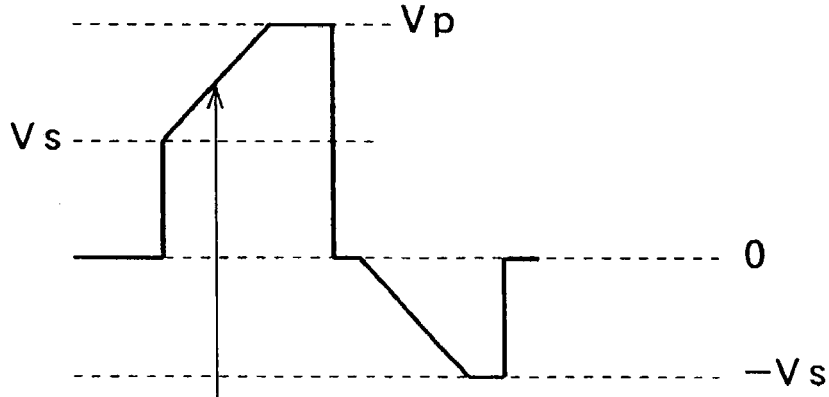
FIG. 5C illustrates a voltage difference between a scanning electrode and a sustaining electrode in the first embodiment in accordance with the present invention.
Figure 5D:
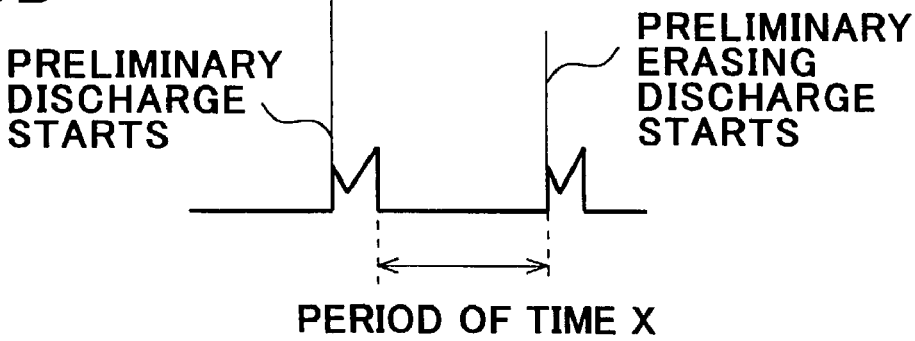
FIG. 5D illustrates a waveform of light emitted in a cell as a result of the voltage difference illustrated in FIG. 5C.

Hereinbelow is explained a method of driving a plasma display panel, in accordance with the first embodiment of the present invention, with reference to FIGS. 5A to 5D in which FIG. 5A illustrates a waveform of a pulse to be applied to the sustaining electrode 4 in a preliminary discharge period, FIG. 5B illustrates a waveform of a pulse to be applied to the scanning electrode 3 in a preliminary discharge period, FIG. 5C illustrates a voltage difference between the scanning electrode 3 and the sustaining electrode 4, and FIG. 5D illustrates a waveform of light emitted in a cell as a result of the voltage difference illustrated in FIG. 5C.

In FIGS. 5A to 5C, Vs indicates a base voltage of both a scanning electrode and a sustaining electrode, and further indicates a voltage amplitude of a sustaining pulse (not illustrated).

As illustrated in FIG. 5A, a preliminary discharge pulse 11*a* to be applied to the sustaining electrode 4 falls down from the base voltage Vs to a ground voltage (GND) at a leading edge, is kept at the ground voltage GND for a certain period of time, and then, rises up from the ground voltage GND to the base voltage Vs at a trailing edge. As illustrated in FIG. 5B, a preliminary discharge pulse 11*b* to be applied to the scanning electrode 3 gently rises up from the base voltage Vs to a voltage Vp at a leading edge, is kept at the voltage Vp for a certain period of time, and then, falls down from the voltage Vp to the base voltage Vs at a trailing edge. As illustrated in FIG. 5B, a preliminary erasing discharge pulse 12 to be applied to the scanning electrode 3 gently falls down from the base voltage Vs to a voltage Vp at a leading edge, is kept at the ground voltage GND for a certain period of time, and then, falls down from the ground voltage GND to the base voltage Vs at a trailing edge.

As illustrated in FIG. 5C, while a voltage difference between the scanning electrode 3 and the sustaining electrode 4 is gently increasing to the voltage Vp from the base voltage Vs, the preliminary discharge is generated, as illustrated in FIG. 5D. The preliminary discharge is kept generated while the voltage difference between the scanning electrode 3 and the sustaining electrode 4 is increasing. Thereafter, a sign of the voltage difference between the scanning electrode 3 and the sustaining electrode 4 is turned to negative one from positive one. Then, the preliminary erasing discharge is generated while the voltage difference is gently decreasing from 0 to −Vs. The preliminary erasing discharge is kept generated while the preliminary erasing discharge is generated while the voltage difference is gently decreasing from 0 to −Vs.

In the first embodiment, a period of time from termination of the preliminary discharge to generation of the preliminary erasing discharge is set shorter than 58 microseconds. Hereinbelow, a period of time from termination of the preliminary discharge to generation of the preliminary erasing discharge is referred to simply as "the period of time X".

In a plasma display panel, when a voltage difference between electrodes is over a threshold voltage at which discharge is generated, discharge is generated between the electrodes, and, after discharge has been generated, wall charges start being accumulated on a dielectric film covering the electrodes therewith. A voltage caused by the wall charges cancels a voltage difference applied from an external circuit, and hence, a voltage difference between the electrodes gradually falls, and, if the voltage difference falls below the above-mentioned threshold voltage, generation of discharge stops.

However, once discharge has been generated, even if a voltage difference between the electrodes falls below the above-mentioned threshold voltage, discharge is kept generated for a few microseconds due to diffusion and/or recombination. Such phenomenon is called afterglow. In the first embodiment, such afterglow is ignored. Hence, termination of the preliminary discharge indicates a timing at which a discharge current or a power of emitted light in the preliminary discharge is reduced down to or below 1% of a peak, and hence, can be scarcely observed. This timing corresponds to a timing at which a voltage difference between the electrodes falls below the above-mentioned threshold voltage, and is almost identical with a timing at which the voltage difference starts being kept at a voltage (Vp+Vs) after the inclining leading edge has been terminated.

The first embodiment is identical with the conventional method with respect to a structure of the plasma display panel, and how the plasma display panel is driven in periods other than the preliminary discharge period, that is, waveforms of pulses to be applied to electrodes, and accordingly, they are not explained.

Figure 6:
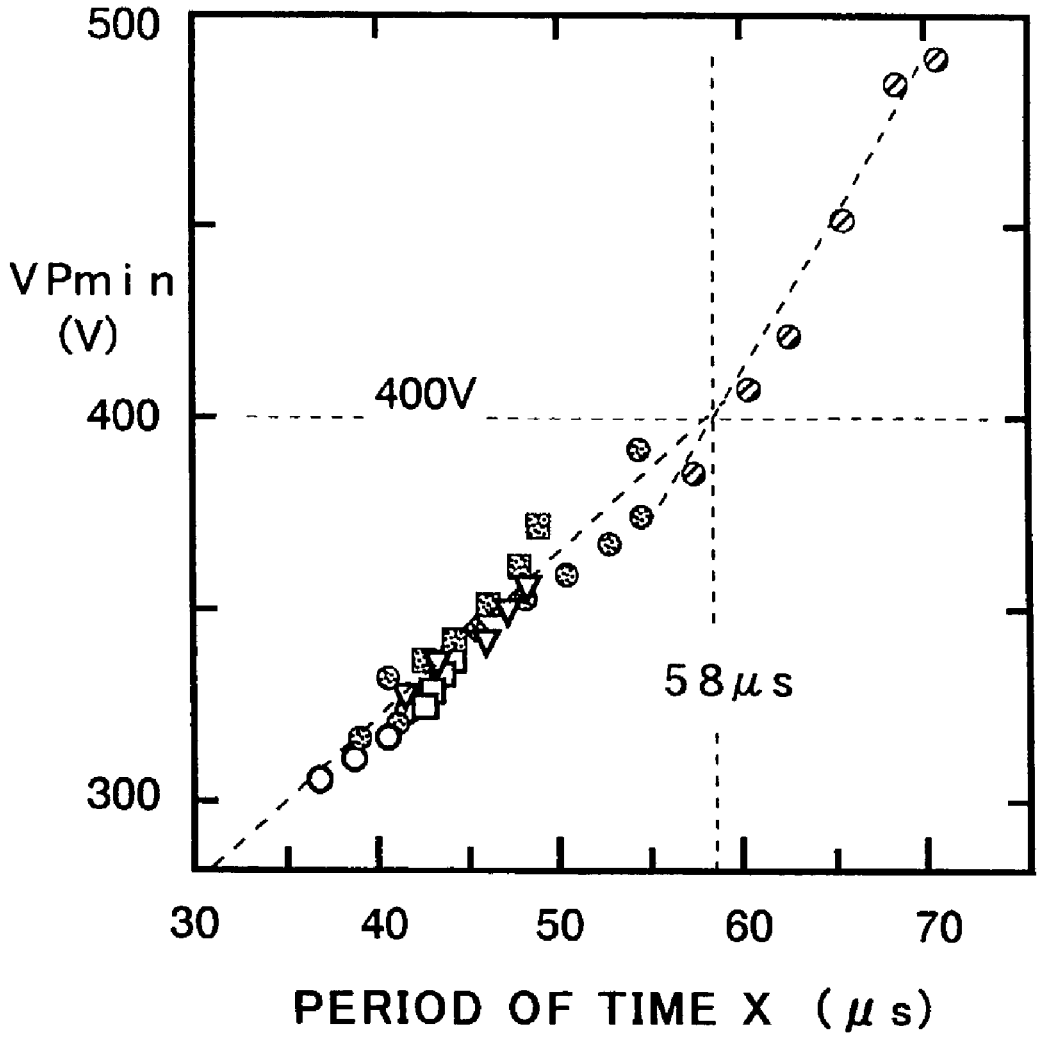
FIG. 6 is a graph showing a relation between a period of time until generation of preliminary erasing discharge from termination of preliminary discharge, and a minimum voltage at which intensive discharge is not generated in preliminary erasing discharge.

FIG. 6 shows a relation between the period of time X, and a minimum voltage Vp at which excessively intensive discharge is not generated in the preliminary erasing discharge.

The plasma display panel having been used to measure the relation shown in FIG. 6 had a cell having a size of 0.81 mm×0.27 mm, and includes discharge gas comprised of Ne at 96% and Xe at 4%, sealed into the discharge space 9 at 400 torr (53.3 kPa). The minimum voltage Vp linearly increases with the lapse of the period of time X, and if the period of time X is over 58 microseconds, it would not be possible to prevent generation of intensive discharge unless the minimum voltage Vp is set equal to or greater than 400 V. The minimum voltage Vp increases at a first rate before the period of time X is not over 58 microseconds, and at a second rate greater than the first rate if the period of time X is over 58 microseconds.

In the first embodiment, the period of time X is set smaller than 58 microseconds to thereby control generation of intensive discharge in dependence on the minimum voltage Vp equal to or smaller than 400 V, because the minimum voltage Vp is less dependent on the period of time X while the minimum voltage Vp is equal to or smaller than 400 V. Accordingly, it would be possible to design devices constituting a circuit for driving the plasma display panel, such as a diode or a field effect transistor (FET), to have a breakdown voltage equal to or smaller than 400 V.

In order to set the period of time X equal to or smaller than 58 microseconds, a period of time in which a voltage is kept equal to the voltage Vp in the waveform of a pulse to be applied to the scanning electrode 3, illustrated in FIG. 5B, may be shortened, a period of time in which a voltage is kept equal to the voltage Vs in the waveform of a pulse to be applied to the scanning electrode 3, illustrated in FIG. 5B, may be shortened, or the preliminary erasing pulse 12 may be designed to have a leading edge having steeper inclination. By designing the preliminary erasing pulse 12 to have a leading edge having steeper inclination, a pulse would reach a voltage difference caused by the preliminary erasing discharge, in a shorter period of time, resulting in that the period of time X is shortened.

Hereinbelow is explained mechanism which determines a relation between the minimum voltage Vp and the period of time X.

Various charged or excited particles are generated by generation of the preliminary discharge, and stay in the discharge space 9. Most of the particles vanish at early time in the period of time X, however, some particles such as Xe metastable level atoms have long lifetime. Since Xe metastable level atoms provide electrons which act as a trigger for generation of discharge, discharge is likely to be generated, if a lot of Xe metastable level atoms exist in the discharge space 9. This is one of phenomena called priming effect, and a particle acting as an electron source, such as Xe metastable level atom, is called priming particle.

In the plasma display panel having been used to measure the relation illustrated in FIG. 6, Xe metastable level atoms exponentially decay due to collision and/or diffusion when decay time constant $\tau$=18.2 microseconds. As the period of time X becomes longer, the number of Xe metastable level atoms is reduced to a greater degree, resulting in that the preliminary erasing discharge becomes harder to be generated, that is, the priming effect becomes weaker. If the priming effect is weak, discharge which should be generated might not be generated, even if a voltage of the serrate pulse reaches a threshold voltage at which the preliminary erasing discharge is to be generated, in which case, discharge is suddenly generated when a voltage of the serrate pulse reaches a certain voltage quite higher than the threshold voltage. Such discharge is not weak discharge which should be originally generated, but intensive discharge which is erroneous discharge and hence causes a problem in driving a plasma display panel.

Herein, "weak discharge which should be originally generated" means discharge generated when a serrate pulse having a leading or trailing edge gently varying. Such weak discharge is kept generated while such a serrate pulse is applied to the electrode, forming wall charges little by little in dependence on an inclined voltage such that an effective voltage difference between the electrodes, partially caused by the wall charges, is kept equal to a voltage at which discharge is generated.

In contrast, intensive discharge forms wall charges in a greater amount than the weak discharge, resulting in that wall charges are formed such that an effective voltage difference between electrodes is significantly below a threshold voltage at which discharge is generated, and hence, discharge rapidly terminates. Herein, the first embodiment is on the assumption that preliminary erasing discharge is generated through the use of a serrate pulse.

As the voltage Vp becomes higher, Xe metastable level atoms are formed in preliminary discharge in a greater amount, resulting in that Xe metastable level atoms would be residual after termination of the preliminary discharge in a greater amount in the same period of time until generation of the preliminary erasing discharge from termination of the preliminary discharge. This ensures that the priming effect becomes intensive, and that it is possible to prevent intensive discharge from being generated, and hence, a problem of erroneous discharge can be solved. Thus, if the period of time X becomes longer, the voltage Vp becomes higher.

If a gas composition and/or a cell structure is varied, the longest period of time in which intensive discharge is not generated varies, as will be obvious in view of the above-mentioned mechanism, because a decay time constant of Xe metastable level atoms varies. If the decay time constant becomes higher, the period of time X has to be shorter.

A relation between the voltage Vp and the period of time X was measured to a gas composition and/or a cell structure other than those shown in FIG. 6. As a result, it was found out that the advantages obtained by the first embodiment could be obtained if the period of time X was smaller than 3T where T indicates a decay time constant $\tau$. The above-mentioned 58 microseconds measured in FIG. 6 is about 3.19 times greater than the decay time constant $\tau$, 18.2 microseconds. That is, by setting the period of time X to be smaller than 3T where T indicates a decay time constant of Xe metastable level atoms, it would be possible to prevent intensive discharge from being generated by a low drive voltage Vp at the generation of the preliminary erasing discharge.

The above-mentioned 400 V below and above which the voltage Vp is dependent on the period of time X in different ways is just an example. If a discharge gas composition and/or a cell structure varies, such a threshold voltage also varies.

[Second Embodiment]

Figure 7A:
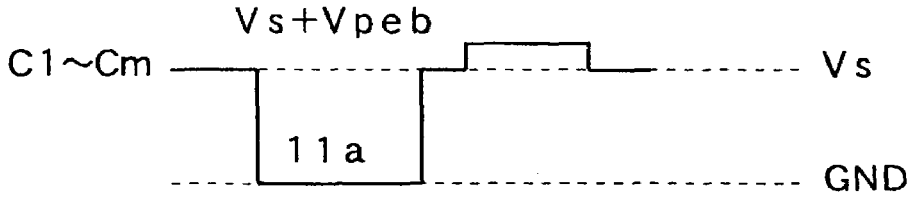
FIG. 7A illustrates a waveform of a pulse to be applied to a sustaining electrode in a preliminary discharge period in the second embodiment in accordance with the present invention.
Figure 7B:
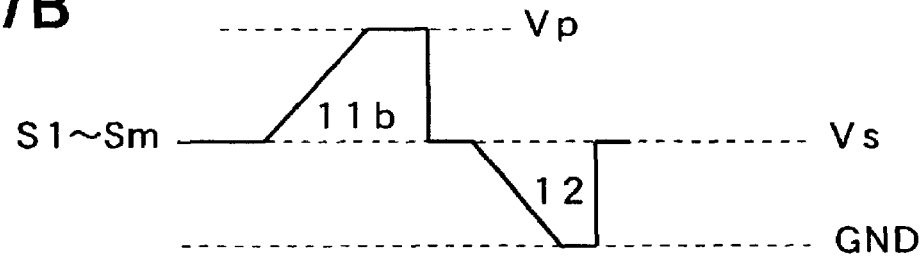
FIG. 7B illustrates a waveform of a pulse to be applied to a scanning electrode in a preliminary discharge period in the second embodiment in accordance with the present invention.
Figure 7C:
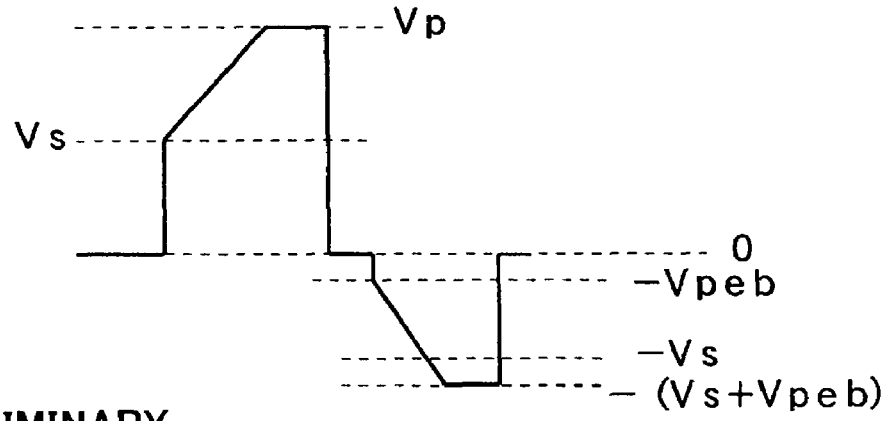
FIG. 7C illustrates a voltage difference between a scanning electrode and a sustaining electrode in the second embodiment in accordance with the present invention.
Figure 7D:
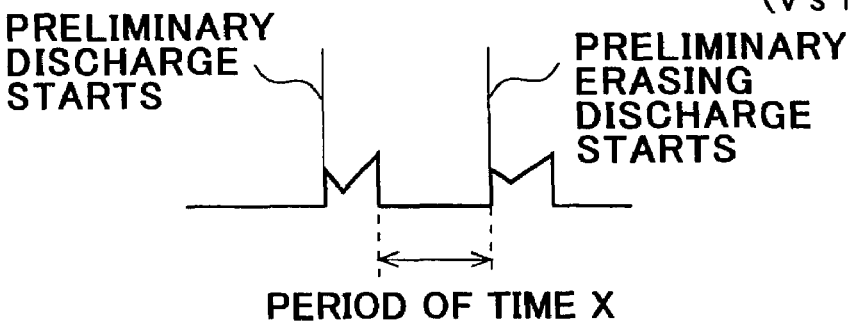
FIG. 7D illustrates a waveform of light emitted in a cell as a result of the voltage difference illustrated in FIG. 7C.

Hereinbelow is explained a method of driving a plasma display panel, in accordance with the second embodiment of the present invention, with reference to FIGS. 7A to 7D in which FIG. 7A illustrates a waveform of a pulse to be applied to the sustaining electrode 4 in a preliminary discharge period, FIG. 7B illustrates a waveform of a pulse to be applied to the scanning electrode 3 in a preliminary discharge period, FIG. 7C illustrates a voltage difference between the scanning electrode 3 and the sustaining electrode 4, and FIG. 7D illustrates a waveform of light emitted in a cell as a result of the voltage difference illustrated in FIG. 7C.

In the second embodiment, while the preliminary erasing discharge pulse 12 is applied to the scanning electrodes 3, a voltage (Vs+Vpeb) greater than the voltage Vs is applied to the sustaining electrodes 4.

As illustrated in FIG. 7C, the voltage difference gently falls down to apply a negative voltage difference across the scanning electrode 3 and the sustaining electrode 4 after the preliminary discharge has been terminated. Specifically, the voltage difference varies in the range of −Vpeb to −(Vs+Vpeb), whereas a voltage difference varies in the range of zero to −Vs in the conventional method.

In accordance with the second embodiment, it is possible to delete a period of time necessary for gently falling down a voltage difference from zero to −Vpeb, ensuring that the period of time X can be shortened. The period of time X can be shortened by newly introducing the voltage Vpeb, and it is also possible to suppress intensive discharge in the generation of the preliminary erasing discharge by means of a low drive voltage Vp.

It was found out that if preliminary erasing discharge was generated at a moment when the voltage difference became the voltage −Vpeb after termination of the preliminary discharge, the preliminary erasing discharge was generated as intensive discharge. Accordingly, the voltage Vpeb has to be determined such that discharge is not generated when the voltage difference becomes −Vpeb by combining the voltage Vpeb and a wall charge voltage formed by the preliminary discharge to each other. Hence, the voltage Vpeb is set smaller than a minimum voltage at which discharge is generated when a voltage of the sustaining electrodes 4 reaches the voltage (Vs+Vpeb) without applying the preliminary erasing pulse 12 to the scanning electrode 3 after application of the preliminary discharge pulses 11*a* and 11*b* to the sustaining and scanning electrodes 4 and 3 has been terminated.

The method in accordance with the second embodiment can be carried out without preparing a new power source, if a voltage of the scanning sub-pulse 17 to be applied to the sustaining electrodes 4 in a scanning period is designed equal to the voltage (Vs+Vpeb). Similarly, the method in accordance with the second embodiment can be carried out without preparing a new circuit, if a driver circuit for outputting the scanning sub-pulse 17 is designed to output a pulse having a voltage (Vs+Vpeb) in synchronization with the preliminary erasing discharge pulse 12.

For simplification of description, FIGS. 7A and 7B illustrate that the pulse Vpeb is applied to the sustaining electrodes 4 at a timing at which the preliminary erasing discharge pulse 12 to be applied to the scanning electrodes 3 starts falling down. However, it should be noted that the pulse Vpeb may be applied to the sustaining electrodes 4 while the preliminary erasing discharge is being generated, that is, earlier than 3T where T indicates a decay time constant. Hence, the pulse Vpeb may be applied to the sustaining electrodes 4 before the preliminary erasing discharge pulse 12 to be applied to the scanning electrodes 3 starts falling down.

However, it is not preferable that the pulse Vpeb is applied to the sustaining electrodes 4 subsequently to a rising-up trailing edge of the preliminary discharge pulse 11*a*. This is because a driver circuit for outputting a pulse (Vs+Vpeb) has to be designed to be able to output an intensive current in a short period of time in order to rise up a voltage from a ground level of the preliminary discharge pulse 11*a* to the voltage (Vs+Vpeb).

It is preferable that the preliminary discharge pulse 11*a* is kept at the voltage Vs for a certain period of time after risen up from a ground level to the voltage Vs, and thereafter, risen up to the voltage (Vs+Vpeb). A driver circuit which keeps a voltage at the Vs or ground voltage has to output a higher power than a driver circuit which outputs a voltage level other than the Vs or ground levels. Accordingly, if a voltage is first kept at the voltage Vs by a high-power driver circuit, and then, is risen up to the voltage (Vs+Vpeb), it would not be necessary for a circuit for rising a voltage up to the voltage (Vs+Vpeb) to be a high-power driver circuit.

[Third Embodiment]

Figure 8A:
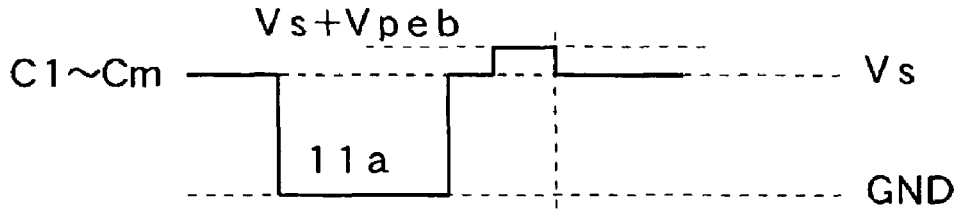
FIG. 8A illustrates a waveform of a pulse to be applied to a sustaining electrode in a preliminary discharge period in the third embodiment in accordance with the present invention.
Figure 8B:
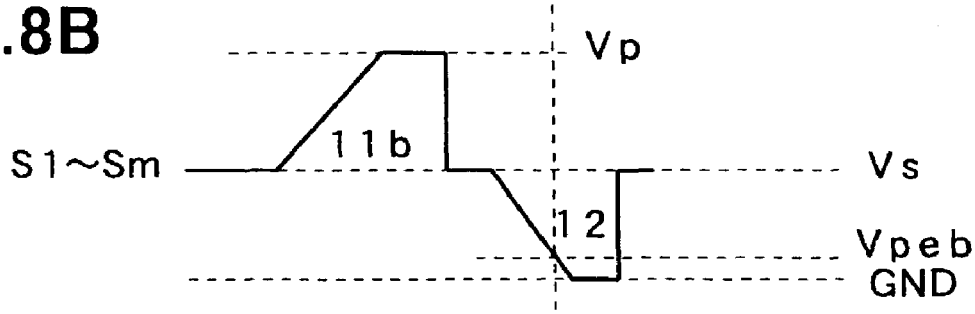
FIG. 8B illustrates a waveform of a pulse to be applied to a scanning electrode in a preliminary discharge period in the third embodiment in accordance with the present invention.
Figure 8C:
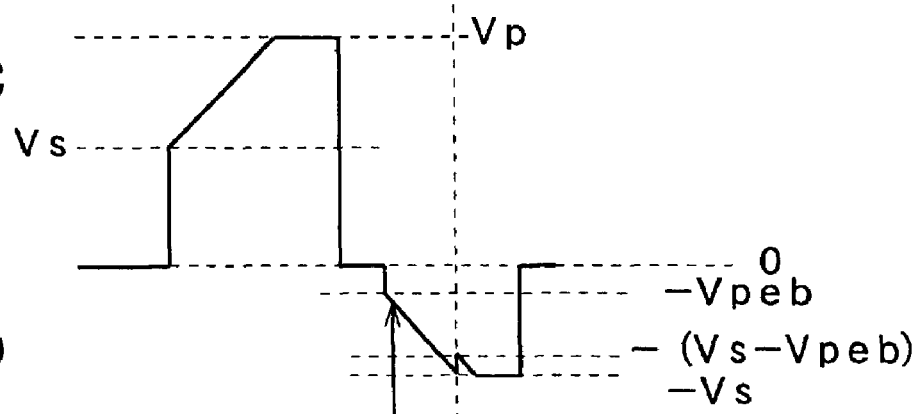
FIG. 8C illustrates a voltage difference between a scanning electrode and a sustaining electrode in the third embodiment in accordance with the present invention.
Figure 8D:
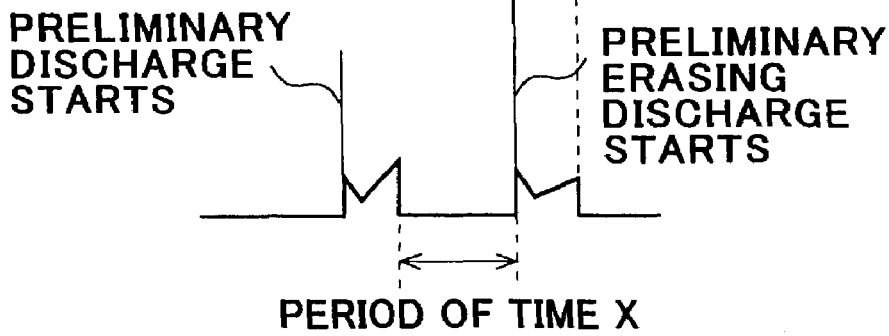
FIG. 8D illustrates a waveform of light emitted in a cell as a result of the voltage difference illustrated in FIG. 8C.

Hereinbelow is explained a method of driving a plasma display panel, in accordance with the third embodiment of the present invention, with reference to FIGS. 8A to 8D in which FIG. 8A illustrates a waveform of a pulse to be applied to the sustaining electrode 4 in a preliminary discharge period, FIG. 8B illustrates a waveform of a pulse to be applied to the scanning electrode 3 in a preliminary discharge period, FIG. 8C illustrates a voltage difference between the scanning electrode 3 and the sustaining electrode 4, and FIG. 8D illustrates a waveform of light emitted in a cell as a result of the voltage difference illustrated in FIG. 8C.

The third embodiment is different from the second embodiment in that a pulse (Vs+Vpeb) to be applied to the sustaining electrodes 4 in synchronization with the preliminary erasing discharge pulse 12 is terminated while the preliminary erasing discharge pulse 12 is falling down at its leading edge, and a pulse to be applied to the sustaining electrodes 4 is fallen down to the voltage Vs.

As illustrated in FIG. 7C, the final voltage difference in the second embodiment is equal to −(Vs+Vpeb) which is greater than −Vs in the conventional method. It was found out that if a final voltage difference during generation of the preliminary erasing discharge was too high, there was generated erroneous discharge which has not been found yet, specifically, sustaining discharge in a non-selected cell.

For instance, assuming that the pulses illustrated in FIGS. 7A and 7B were applied to a plasma display panel, erroneous discharge was generated though intensive discharge was not generated during generation of the preliminary erasing discharge, if the voltage Vpeb was over 30 V when the voltage Vs was equal to 165 V and the voltage Vp was equal to 320 V. In order to avoid such erroneous discharge, it is necessary for the voltage difference at the generation of the preliminary erasing discharge not to exceed the voltage (−Vs). Accordingly, in the third embodiment, a voltage of the sustaining electrodes 4 is fallen down to the voltage Vs from the voltage (Vs+Vpeb) before a leading edge of the preliminary erasing discharge pulse 12 to be applied to the scanning electrodes 3 reaches the voltage Vpeb.

In the third embodiment, as illustrated in FIGS. 8A to 8D, just when a leading edge of the preliminary erasing discharge pulse 12 reaches the voltage Vpeb, a voltage of the sustaining electrodes 4 is fallen down to the voltage Vs. The voltage difference between the scanning and sustaining electrodes 3 and 4 is equal to −Vs, when a leading edge of the preliminary erasing discharge pulse 12 applied to the scanning electrodes 3 is equal to the voltage Vpeb, and a voltage applied to the sustaining electrodes 4 is equal to the voltage Vs. However, by falling a voltage applied to the sustaining electrodes 4 down to the voltage Vs, the voltage difference can be reduced down to −(Vs−Vpeb). Since a voltage applied to the sustaining electrodes 4 is kept at the voltage Vs thereafter, the voltage difference would be −Vs, even if a leading edge of the preliminary erasing discharge pulse 12 applied to the scanning electrodes 3 gradually falls down, and finally reaches a ground voltage.

Thus, the voltage difference between the scanning and sustaining electrodes 3 and 4 is always smaller than −Vs.

In accordance with the third embodiment, it was possible to raise the voltage Vpeb up to 70V, when the pulses illustrated in FIGS. 7A to 7C were applied to a plasma display panel, the voltage Vs was set equal to 165V, and the voltage Vp was set equal to 320V.

The preliminary erasing discharge terminates when a voltage applied to the sustaining electrodes 4 is fallen down to the voltage Vs from the voltage (Vs+Vpeb).

In accordance with the third embodiment, it is possible to readily shorten the period of time X, and suppress intensive discharge during the preliminary erasing discharge by a low drive voltage. In addition, since the voltage difference between the scanning and sustaining electrodes 3 and 4 while the preliminary erasing discharge pulse 12 is being applied to the scanning electrodes 3 is in the range of 0 and −Vs, it is also possible the above-mentioned problem which was newly caused, because the voltage difference was over −Vs.

[Fourth Embodiment]

Figure 9A:
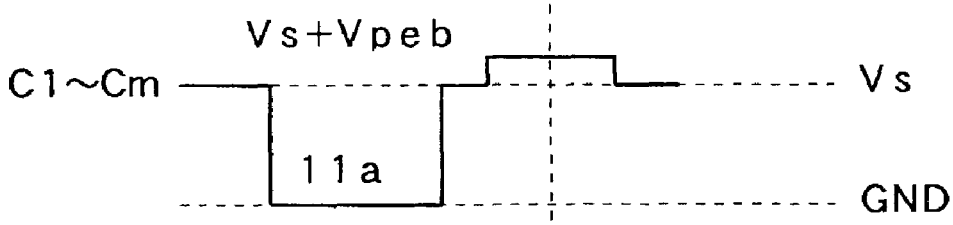
FIG. 9A illustrates a waveform of a pulse to be applied to a sustaining electrode in a preliminary discharge period in the fourth embodiment in accordance with the present invention.
Figure 9B:
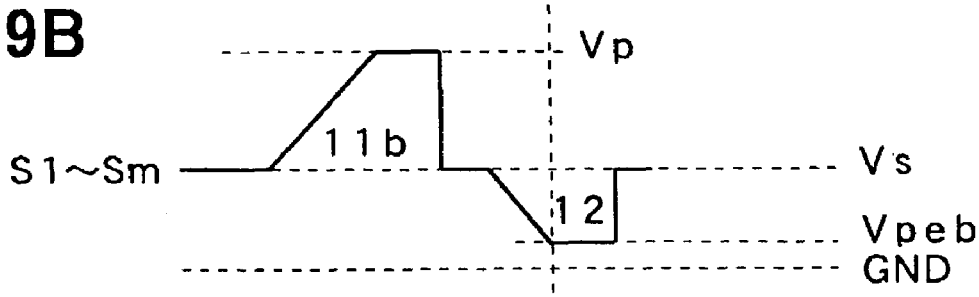
FIG. 9B illustrates a waveform of a pulse to be applied to a scanning electrode in a preliminary discharge period in the fourth embodiment in accordance with the present invention.
Figure 9C:
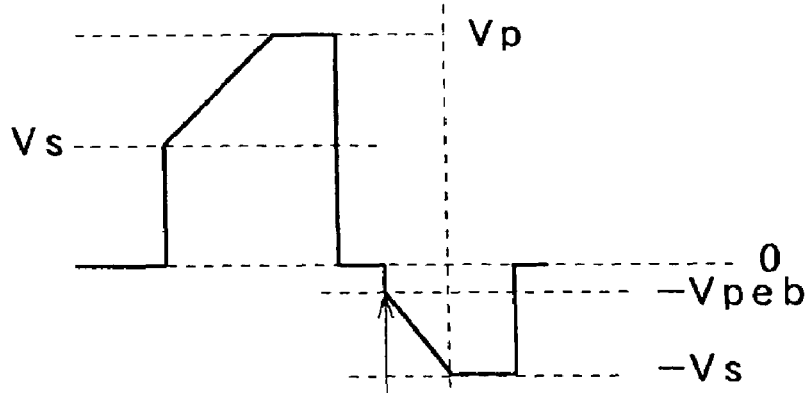
FIG. 9C illustrates a voltage difference between a scanning electrode and a sustaining electrode in the fourth embodiment in accordance with the present invention.
Figure 9D:
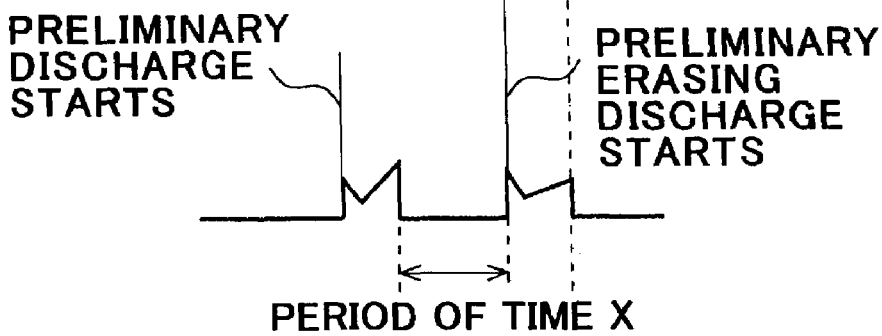
FIG. 9D illustrates a waveform of light emitted in a cell as a result of the voltage difference illustrated in FIG. 9C.

Hereinbelow is explained a method of driving a plasma display panel, in accordance with the fourth embodiment of the present invention, with reference to FIGS. 9A to 9D in which FIG. 9A illustrates a waveform of a pulse to be applied to the sustaining electrode 4 in a preliminary discharge period, FIG. 9B illustrates a waveform of a pulse to be applied to the scanning electrode 3 in a preliminary discharge period, FIG. 9C illustrates a voltage difference between the scanning electrode 3 and the sustaining electrode 4, and FIG. 9D illustrates a waveform of light emitted in a cell as a result of the voltage difference illustrated in FIG. 9C.

The fourth embodiment is different from the second embodiment in that the preliminary erasing discharge pulse 12 finally reaches a voltage higher than the voltage Vpeb.

In the fourth embodiment, as illustrated in FIG. 9B, the preliminary erasing discharge pulse 12 is designed to finally reach the voltage Vpeb.

When a leading edge of the preliminary erasing discharge pulse 12 applied to the scanning electrodes 3 reaches the voltage Vpeb, a voltage (Vs+Vpeb) is applied to the sustaining electrodes 4. Accordingly, the voltage difference between the scanning and sustaining electrodes 3 and 4 is equal to − Vs. Since a voltage of the preliminary erasing discharge pulse 12 is not smaller than the voltage Vpeb and a voltage applied to the sustaining electrodes 4 is not greater than the voltage (Vs+Vpeb), the voltage difference between the scanning and sustaining electrodes 3 and 4 is always smaller than −Vs.

Accordingly, similarly to the third embodiment, the fourth embodiment makes it possible to readily shorten the period of time X, and suppress intensive discharge during the preliminary erasing discharge by a low drive voltage. In addition, since the voltage difference between the scanning and sustaining electrodes 3 and 4 while the preliminary erasing discharge pulse 12 is being applied to the scanning electrodes 3 is in the range of 0 and −Vs similarly to the conventional method, it is also possible the above-mentioned problem which was newly caused, because the voltage difference was over −Vs.

[Fifth Embodiment]

Figure 10A:
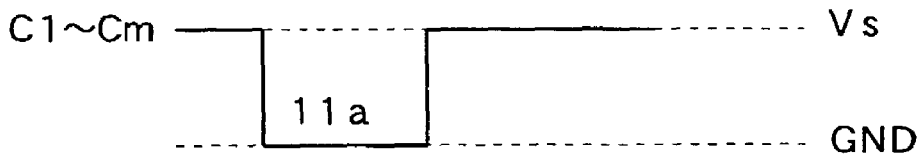
FIG. 10A illustrates a waveform of a pulse to be applied to a sustaining electrode in a preliminary discharge period in the fifth embodiment in accordance with the present invention.
Figure 10B:
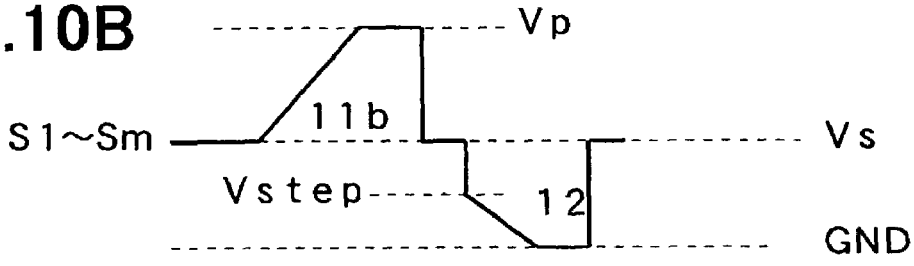
FIG. 10B illustrates a waveform of a pulse to be applied to a scanning electrode in a preliminary discharge period in the fifth embodiment in accordance with the present invention.
Figure 10C:
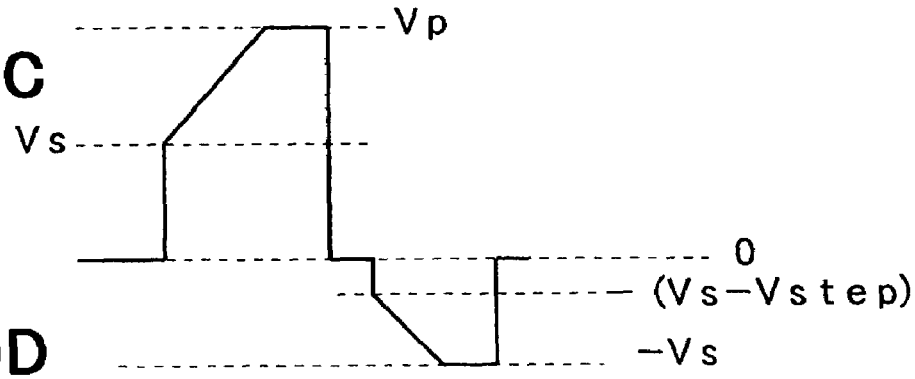
FIG. 10C illustrates a voltage difference between a scanning electrode and a sustaining electrode in the fifth embodiment in accordance with the present invention.
Figure 10D:
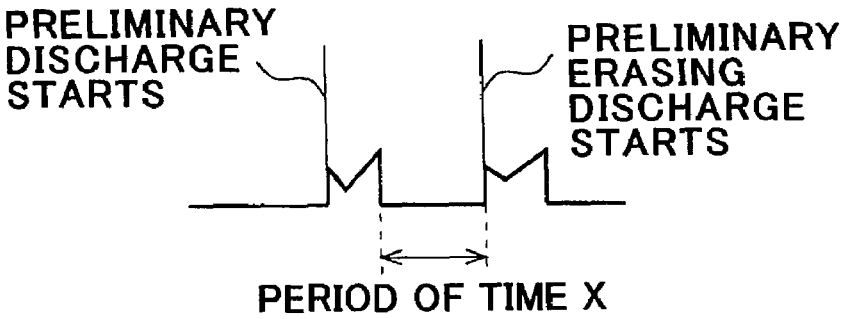
FIG. 10D illustrates a waveform of light emitted in a cell as a result of the voltage difference illustrated in FIG. 10C.

Hereinbelow is explained a method of driving a plasma display panel, in accordance with the fifth embodiment of the present invention, with reference to FIGS. 10A to 10D in which FIG. 10A illustrates a waveform of a pulse to be applied to the sustaining electrode 4 in a preliminary discharge period, FIG. 10B illustrates a waveform of a pulse to be applied to the scanning electrode 3 in a preliminary discharge period, FIG. 10C illustrates a voltage difference between the scanning electrode 3 and the sustaining electrode 4, and FIG. 10D illustrates a waveform of light emitted in a cell as a result of the voltage difference illustrated in FIG. 10C.

In the fifth embodiment, the preliminary erasing discharge pulse 12 to be applied to the scanning electrodes 3 steeply falls down to a voltage Vstep from the voltage Vs, and then, further gently falls down to a ground voltage from the voltage Vstep.

As illustrated in FIG. 10C, when a pulse having a negative sign is applied across the scanning and sustaining electrodes 3 and 4 after termination of the application of the preliminary discharge pulses 11*a* and 11*b*, a leading edge of the negative pulse varies to the voltage −Vs from the voltage −(Vs−Vstep), whereas a leading edge of the pulse varies to the voltage −Vs from zero (0) in the conventional method.

In accordance with the fifth embodiment, it is possible to delete a period of time necessary for the pulse to gently fall down to the voltage −(Vs−Vstep) from zero, ensuring that the period of time X can be shortened. The period of time X can be shortened by newly introducing the voltage Vpeb, and it is also possible to suppress intensive discharge during the generation of the preliminary erasing discharge by means of a low drive voltage Vp.

It was found out that if the preliminary erasing discharge was generated at a moment when the voltage difference reached the voltage −(Vs−Vstep) after the termination of the application of the preliminary discharge pulses 11*a* and 11*b*, the preliminary erasing discharge was generated as intensive discharge. Hence, the voltage Vstep has to be determined to be such a voltage that discharge is not generated when the voltage difference defined as a sum of the voltage Vstep and a wall charge voltage formed by the preliminary discharge reaches the voltage −(Vs−Vstep). Specifically, the voltage Vstep is set smaller than a minimum voltage at which discharge is generated when a voltage of the sustaining electrodes 4 is set equal to the voltage Vs and a voltage of the scanning electrode 3 is set equal to the voltage Vstep after termination of the preliminary erasing discharge pulse 12. For instance, the voltage Vstep may be set smaller than 70V when the voltage Vs is set equal to 165V and the voltage Vp is set equal to 320V in the plasma display panel having the relation illustrated in FIG. 6.

It is not preferable that a trailing edge of the preliminary discharge pulse 11*b* which falls down is continuous with a leading edge of the voltage Vstep which falls down. This is because a driver circuit for outputting a pulse Vpeb has to be designed to be able to output an intensive current in a short period of time in order to continuously fall down the voltage Vp of the preliminary discharge pulse 11*b* to the voltage Vstep. It is preferable that the preliminary discharge pulse 11*b* is kept at the voltage Vs for a certain period of time after fallen down from the voltage Vp, and thereafter, fallen down to the voltage Vstep.

The method in accordance with the fifth embodiment can be carried out without preparing a new power source, if a voltage of the scanning base pulse 18 to be applied to the scanning electrodes 3 in a scanning period is designed equal to the voltage Vstep. Similarly, the method in accordance with the fifth embodiment can be carried out without preparing a new circuit, if a driver circuit for outputting the scanning base pulse 18 is designed to output a pulse having the voltage Vstep.

Steep rising-up and falling-down of a pulse in the description having been made above means such a voltage change as being generated by digitally turning on a switching device such as a field effect transistor (FET). A plasma display panel has capacitive load therein, and thus, such steep rising-up and falling-down of a pulse take about 1 microsecond, particularly in a large-sized panel. If expressed in a rate per a unit time, the rate is equal to or greater than 100 V/μs. On the other hand, gentle rising-up and falling-down of a pulse in the description having been made above means such a voltage change as being generated by gradually varying an impedance of a switching device while the switching device is on. If expressed in a rate per a unit time, the rate is equal to or smaller than 10 V/μs.

Though Xe metastable level atoms are described as most primary priming particles in the above-mentioned first to fifth embodiments, charged or excited particles other than Xe metastable level atoms may be selected as priming particles, if a discharge gas composition is changed from the same used in the first to fifth embodiments. Even in such a case, it is possible to suppress intensive discharge similarly to the first to fifth embodiments by setting the period of time X to be shorter than 3T where T indicates a decay time constant of the most primary priming particle.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-097945 filed on Mar. 29, 2002 including specification, claims, drawings and summary is incorporated herein by reference in its entirety.

What is claimed is:

1. A method of driving a plasma display panel including a plurality of scanning electrodes covered with a dielectric layer, and a plurality of sustaining electrodes covered with a dielectric layer, comprising the steps of:

(a) applying scanning pulses in time-division to said scanning electrodes in an addressing period in which a cell or cells emitting light is(are) selected, and applying sustaining pulses to said sustaining electrodes in a sustaining period for generating preliminary discharge and preliminary erasing discharge before said cell or cells emitting light is(are) selected; and (b) applying a serrate pulse to said scanning or sustaining electrodes when said preliminary erasing discharge is generated, said serrate pulse having an inclination smaller than 10 V/μs, wherein a period of time until the generation of said preliminary erasing discharge from the termination of said preliminary discharge is set shorter than 3T where T indicates a decay time constant of priming particles.

2. The method as set forth in claim 1, wherein said priming particles are xenon (Xe) metastable level atoms, and said period of time is shorter than 58 microseconds.

3. A method of driving a plasma display panel including a plurality of scanning electrodes covered with a dielectric layer, and a plurality of sustaining electrodes covered with a dielectric layer, comprising the steps of:

(a) applying scanning pulses in time-division to said scanning electrodes in an addressing period in which a cell or cells emitting light is(are) selected, and applying sustaining pulses to said sustaining electrodes in a sustaining period for generating preliminary discharge and preliminary erasing discharge before said cell or cells emitting light is(are) selected; and (b) applying a serrate pulse to said scanning or sustaining electrodes when said preliminary erasing discharge is generated, said serrate pulse having an inclination smaller than 10 V/μs, wherein in a period including a first period in which said serrate pulse is applied to one of said scanning and sustaining electrodes for generating said preliminary erasing discharge, a first pulse having a sign opposite to a sign of said serrate pulse with respect to a base voltage is applied to the other of said scanning and sustaining electrodes.

4. The method as set forth in claim 3, wherein said serrate pulse is applied to said scanning electrodes and said first pulse is applied to said sustaining electrodes, and said first pulse has a voltage equal to a voltage of a pulse applied to said sustaining electrodes in said addressing period.

5. The method as set forth in claim 3, further comprising the step of stopping applying a second voltage to said other of said scanning and sustaining electrodes for returning said other of said scanning and sustaining electrodes back to a base voltage, before said serrate pulse reaches a third voltage, wherein said second voltage is defined as a voltage having a sign opposite to a sign of said serrate pulse with respect to said base voltage to be applied to said other of said scanning and sustaining electrodes, said third voltage is defined as a voltage closer to said base voltage than a first voltage by a bias-voltage difference, said first voltage is defined as a voltage to which said serrate pulse finally reaches, and said bias-voltage difference is defined as a difference between said base voltage and said second voltage.

6. The method as set forth in claim 5, wherein said first voltage is a ground (GND) voltage.

7. The method as set forth in claim 3, wherein a first bias-voltage difference defined as a difference between a ground voltage and a first voltage is greater than a second bias-voltage difference between said base voltage and a second voltage, wherein said serrate pulse has a negative sign, said first voltage is defined as a voltage to which said serrate pulse finally reaches, and said second voltage is defined as a voltage which has a positive sign and is applied to said other of said scanning and sustaining electrodes.

8. The method as set forth in claim 3, wherein a period of time until the generation of said preliminary erasing discharge from the termination of said preliminary discharge is set shorter than 3T where T indicates a decay time constant of priming particles.

9. The method as set forth in claim 3, wherein a period of time until the generation of said preliminary erasing discharge from the termination of said preliminary discharge is set shorter than 58 microseconds.

10. The method as set forth in claim 3, wherein a voltage to be applied to said scanning and sustaining electrodes is kept equal to a base voltage of said scanning and sustaining electrodes in a period between a period in which said preliminary discharge is generated and a period in which the next preliminary discharge is generated.

11. The method as set forth in claim 3, wherein said base voltage is equal to a maximum or minimum of an amplitude of said sustaining pulse.

12. The method as set forth in claim 11, wherein said maximum or minimum of an amplitude of said sustaining pulse is equal to a ground voltage.

13. A method of driving a plasma display panel including a plurality of scanning electrodes covered with a dielectric layer, and a plurality of sustaining electrodes covered with a dielectric layer, comprising the steps of:

(a) applying scanning pulses in time-division to said scanning electrodes in an addressing period in which a cell or cells emitting light is(are) selected, and applying sustaining pulses to said sustaining electrodes in a sustaining period for generating preliminary discharge and preliminary erasing discharge before said cell or cells emitting light is(are) selected; and (b) applying a serrate pulse to one of said scanning and sustaining electrodes when said preliminary erasing discharge is generated wherein said serrate pulse falls down or rises up to a first voltage from a base voltage at 100 V/μs or greater and falls down or rises up to a second voltage from said first voltage at 10 V/μs or smaller.

14. The method as set forth in claim 13, wherein said serrate pulse is applied to said scanning electrodes, and said first voltage is equal to a voltage of a pulse applied to said sustaining electrodes while said scanning pulse is not applied to said sustaining electrodes, in said addressing period.

15. The method as set forth in claim 13, wherein a period of time until the generation of said preliminary erasing discharge from the termination of said preliminary discharge is set shorter than 3T where T indicates a decay time constant of priming particles.

16. The method as set forth in claim 13, wherein a period of time until the generation of said preliminary erasing discharge from the termination of said preliminary discharge is set shorter than 58 microseconds.

17. The method as set forth in claim 13, wherein a voltage to be applied to said scanning and sustaining electrodes is kept equal to a base voltage of said scanning and sustaining electrodes in a period between a period in which said preliminary discharge is generated and a period in which the next preliminary discharge is generated.

18. The method as set forth in claim 13, wherein said base voltage is equal to a maximum or minimum of an amplitude of said sustaining pulse.

19. The method as set forth in claim 18, wherein said maximum or minimum of an amplitude of said sustaining pulse is equal to a ground voltage.

* * * * *